US007891331B2

(12) United States Patent
Kawarai

(10) Patent No.: US 7,891,331 B2
(45) Date of Patent: Feb. 22, 2011

(54) SYNTHETIC RESIN TUBE STRUCTURE

(75) Inventor: Hiroyuki Kawarai, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 12/591,557

(22) Filed: Nov. 23, 2009

(65) Prior Publication Data

US 2010/0071651 A1 Mar. 25, 2010

Related U.S. Application Data

(63) Continuation of application No. PCT/JP2008/058874, filed on May 14, 2008.

(30) Foreign Application Priority Data

May 23, 2007 (JP) ..... 2007-136627

(51) Int. Cl.
*F02M 35/10* (2006.01)

(52) U.S. Cl. ..... 123/184.61; 123/184.53

(58) Field of Classification Search ..... 123/184.21–184.61
See application file for complete search history.

(56) References Cited

U.S. PATENT DOCUMENTS

2002/0046725 A1* 4/2002 Ogata ..... 123/184.61
2006/0240206 A1 10/2006 Kito et al.

FOREIGN PATENT DOCUMENTS

CN 200480016258.5 7/2006
EP 1 640 602 A1 3/2006
JP 2005-23931 1/2005
JP 2005-069118 3/2005
WO 2004/111426 A1 12/2004

OTHER PUBLICATIONS

International Search Report for PCT/JP2008/058874, mailed Sep. 2, 2008.
English Translation of the International Preliminary Report on Patentability mailed Jan. 21, 2010 and issued in corresponding International Patent Application PCT/JP2008/058874.

* cited by examiner

*Primary Examiner*—Noah Kamen

(57) ABSTRACT

A synthetic resin tube structure including a first synthetic-resin member which includes a flange having a plurality of bores formed therein, and a plurality of first divided pipes formed integrally with the flange; and a second synthetic-resin member which includes a plurality of second divided pipes, and a connector to connect the plurality of second divided pipes to each other. In the synthetic resin tube structure, the plurality of first and second divided pipes are subjected to vibration welding to form a plurality of pipes respectively having therein passages which communicate with the respective corresponding bores, and the vibration welding is performed while a direction, in which the plurality of first and second divided pipes are vibrated, is inclined at an angle θ with respect to a reference plane in a direction perpendicular to an axial direction of each of the bores formed in the flange.

4 Claims, 7 Drawing Sheets

FIG. 5 – Prior Art
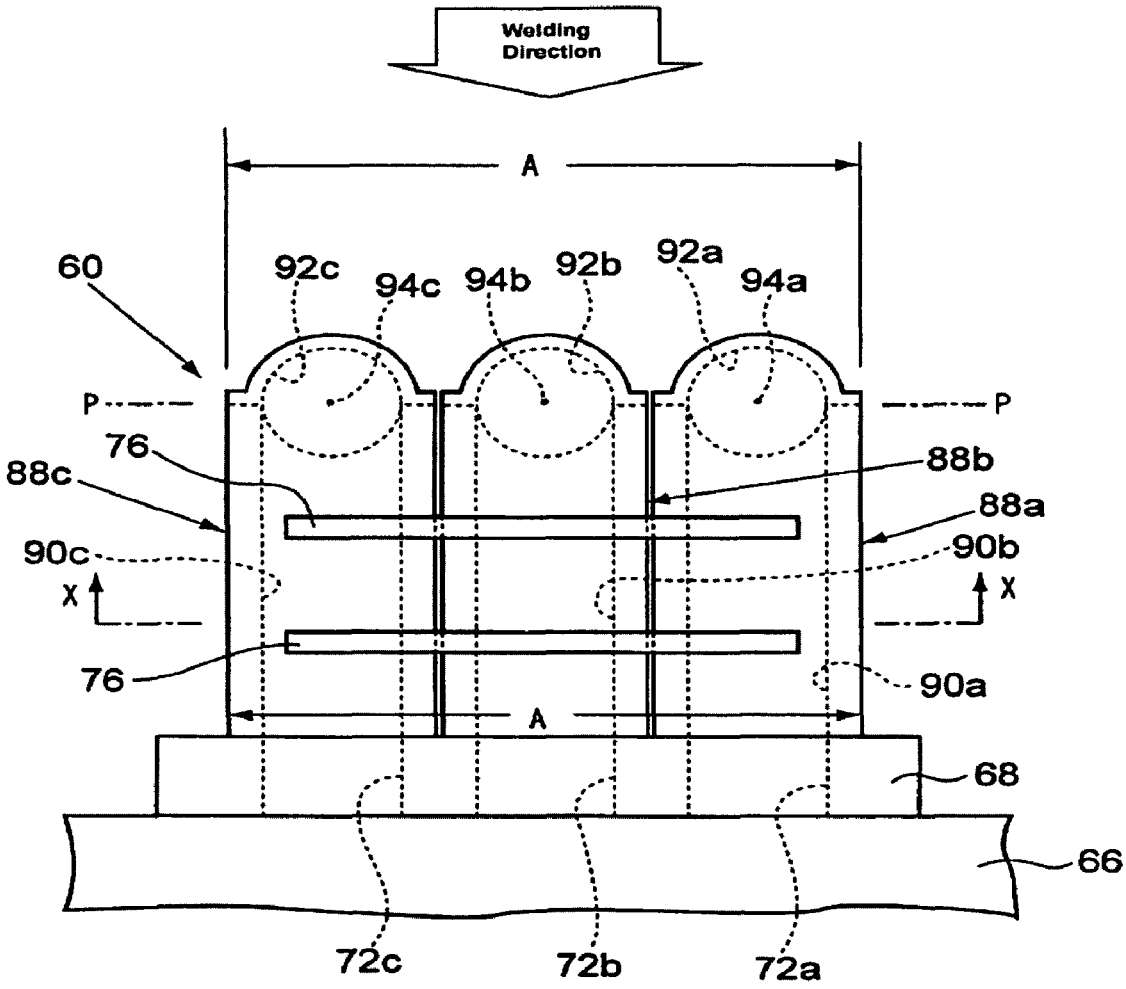

FIG. 6 – Prior Art
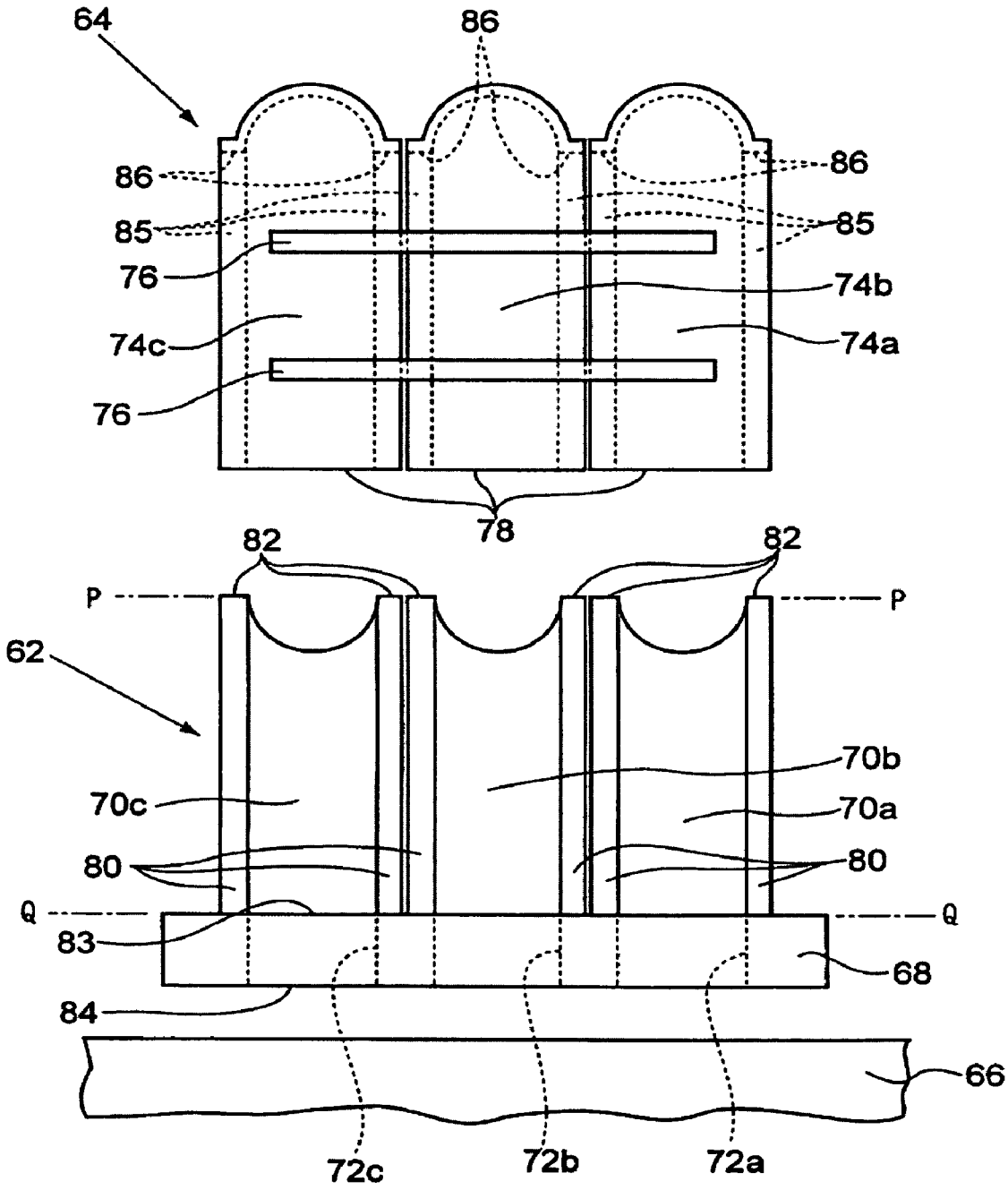

FIG. 7 – Prior Art
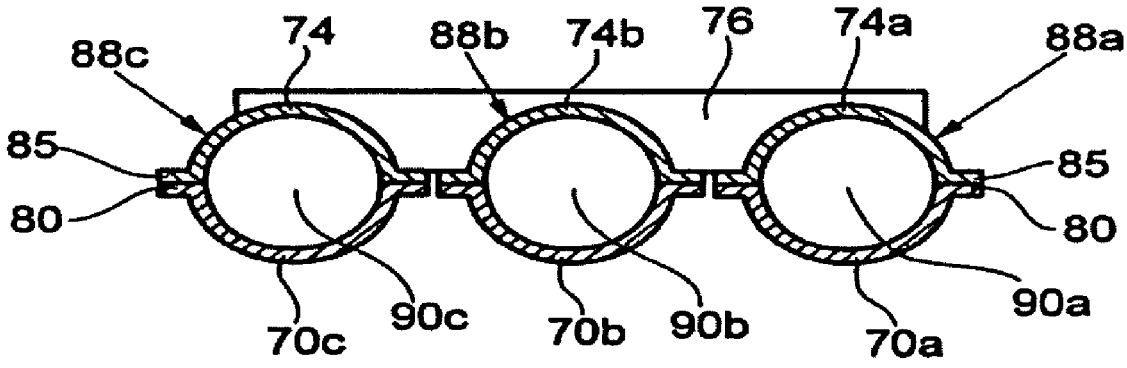

SYNTHETIC RESIN TUBE STRUCTURE

CROSS-REFERENCE TO RELATED APPLICATIONS

This application is a continuation, filed under 35 U.S.C. §111(a), of PCT international application No. PCT/JP2008/058874, filed May 14, 2008, which application claims the priority benefit of Japanese patent application No. 2007-136627, filed May 23, 2007, the disclosures of which are incorporated herein by reference.

BACKGROUND

1. Field

The present invention relates to a synthetic resin tube structure, which is formed by welding two synthetic-resin members together.

2. Description of the Related Art

For a case where a multicylinder engine is used, an intake manifold, in which the same number of intake passages as that of cylinders are formed, is provided between the engine and a throttle body. A plurality of intake pipes, each having a different shape and intake passage, are formed in the intake manifold, and hence an intake manifold made of a synthetic resin has been provided in terms of ease of formation of the shape of the intake pipe, reduction in weight, reduction in cost, and the like, as shown in JP 2005-69118 A.

Here, a basic structure of the intake manifold made of the synthetic resin, which is described in JP 2005-69118 A, is described with reference to FIGS. 5 to 7. An intake manifold 60 includes two synthetic-resin members, i.e., a first synthetic-resin member 62 and a second synthetic-resin member 64 and is formed by welding the two synthetic-resin members 62 and 64 together. The first synthetic-resin member 62 includes: a flange 68 to be connected to an engine 66; and a plurality of first divided pipes 70*a*, 70*b*, and 70*c* integrally formed with the flange 68. A plurality of bores 72*a*, 72*b*, and 72*c*, each serving as a passage to the engine 66, are formed through the flange 68. Each of the first divided pipes 70*a*, 70*b*, and 70*c* has a semicircular or semi-elliptical sectional shape in a direction perpendicular to a longitudinal direction thereof in most parts.

The second synthetic-resin member 64 includes: a plurality of second divided pipes 74*a*, 74*b*, and 74*c* to be welded to the flange 68 and the plurality of first divided pipes 70*a*, 70*b*, and 70*c*; and connectors 76 for connecting the plurality of second divided pipes 74*a*, 74*b*, and 74*c* to each other in a fixed manner. Each of the second divided pipes 74*a*, 74*b*, and 74*c* has a semicircular or semi-elliptical sectional shape in a direction perpendicular to a longitudinal direction thereof in most parts. An edge of each of the second divided pipes 74*a*, 74*b*, and 74*c* on the side of the flange 68 is referred to as a joint edge 78.

First welding ribs 80 are formed on both sides of each of the plurality of first divided pipes 70*a*, 70*b*, and 70*c*. A first fore-end portion 82 is formed on a free fore-end side of each of the first welding ribs 80 provided on both the right and left sides. If a plane which connects the first fore-end portions 82 to each other is indicated by a line P-P in FIG. 6 and a reference plane of the flange 68 on the side of the first divided pipes 70*a*, 70*b*, and 70*c* is indicated by a line Q-Q in FIG. 6, then the line P-P is set to be parallel to the line Q-Q. The reference plane of the flange 68 is perpendicular to a direction in which the bores 72*a*, 72*b*, and 72*c* of the flange 68 extend. Although the reference plane of the flange 68 (at a position of the line Q-Q) is an end surface 83 of the flange 68, which is on the side to be connected to the first divided pipes 70*a*, 70*b*, and 70*c*, in FIG. 6, the reference plane may also be an end surface 84 of the flange 68, which is brought into contact with the engine 66. On the other hand, second welding ribs 85 are formed on both the right and left sides of each of the plurality of second divided pipes 74*a*, 74*b*, and 74*c*, whereas a second fore-end portion 86 is formed on the fore-end side of each of the welding second ribs 85 provided on both the sides.

For welding the first synthetic-resin member 62 and the second synthetic-resin member 64 together, the first welding ribs 80 provided on both the right and left sides of each of the first divided pipes 70*a*, 70*b*, and 70*c* are brought into contact with the second welding ribs 85 provided on both the right and left sides of each of the second divided pipes 74*a*, 74*b*, and 74*c* to bring the first fore-end portions 82 provided on both sides of the fore-end of each of the first divided pipes 70*a*, 70*b*, and 70*c* into contact with the second fore-end portions 86 provided on both sides of the fore-end of each of the second divided pipes 74*a*, 74*b*, and 74*c*, thereby bringing the joint edges 78 of the second divided pipes 74*a*, 74*b*, and 74*c* into contact with the flange 68. In this state, all the portions being in contact with each other are welded by vibration welding. A direction, in which the first divided pipes 70*a*, 70*b*, and 70*c* and the second divided pipes 74*a*, 74*b*, and 74*c* are vibrated, is parallel to the line P-P (line Q-Q), and the welding is performed in a direction perpendicular to the line P-P (in a direction indicated by an arrow of FIG. 5). Along with the welding between the first divided pipes 70*a*, 70*b*, and 70*c* and the second divided pipes 74*a*, 74*b*, and 74*c*, the second divided pipes 74*a*, 74*b*, and 74*c* and the flange 68 are welded to each other. As a result of the welding, a plurality of pipes 88*a*, 88*b*, and 88*c* are formed by the first divided pipes 70*a*, 70*b*, and 70*c* and the second divided pipes 74*a*, 74*b*, and 74*c* (FIG. 5). Inside the pipes 88*a*, 88*b*, and 88*c*, passages 90*a*, 90*b*, and 90*c*, each having a circular or elliptical cross section, are respectively formed.

Ends on the side of the passages 90*a*, 90*b*, and 90*c* are respectively in communication with the bores 72*a*, 72*b*, and 72*c* of the flange 68. At ends on the other side of the passages 90*a*, 90*b*, and 90*c*, ports 92*a*, 92*b*, and 92*c* are respectively formed. Here, if the respective center positions of the ports 92*a*, 92*b*, and 92*c* are center points 94*a*, 94*b*, and 94*c*, then a plane containing the center points 94*a*, 94*b*, and 94*c* are positioned on the line P-P.

The direction, in which the vibrations for welding are made, is set to be parallel to the line Q-Q of the reference plane of the flange 68, and hence a position of the plane which connects the respective center points 94*a*, 94*b*, and 94*c* of the ports 92*a*, 92*b*, and 92*c* also becomes parallel to the line Q-Q. A total width (length A) of the three pipes 88*a*, 88*b*, and 88*c* at the positions where the ports 92*a*, 92*b*, and 92*c* are situated is equal to a width (length A) of portions of the pipes 88*a*, 88*b*, and 88*c*, which are connected to the flange 68. In other words, a large space is required for the pipes 88*a*, 88*b*, and 88*c* at the positions where the ports 92*a*, 92*b*, and 92*c* are situated.

SUMMARY

The present invention has been made in view of the problem described above, and therefore has an aspect of providing a synthetic resin tube structure, which allows a width of a plurality of pipes at positions where ports are situated to be shortened so as to reduce a space at the positions where the ports are situated when the plurality of pipes are formed by welding two synthetic-resin members together.

In order to achieve the above-mentioned aspect, a synthetic resin tube structure includes a first synthetic-resin member including a flange having a plurality of bores formed therein; a plurality of first divided pipes formed integrally with the flange; a second synthetic-resin member including a plurality of second divided pipes; and a connection arm to connect the plurality of second divided pipes to each other, the plurality of first divided pipes and the plurality of second divided pipes being subjected to vibration welding to form a plurality of pipes respectively including therein passages which are communicating with the respective corresponding bores, characterized in that the vibration welding is performed while a direction, in which the plurality of first divided pipes and the plurality of second divided pipes are vibrated, is inclined at an angle θ with respect to a reference plane in a direction perpendicular to an axial direction of each of the bores formed in the flange. The synthetic resin tube structure is characterized in that the angle θ falls within a range of: $5° \leqq \theta \leqq 40°$. Further, the synthetic resin tube structure is characterized by being used as an intake manifold for an internal combustion engine.

Additional aspects and/or advantages will be set forth in part in the description which follows and, in part, will be apparent from the description, or may be learned by practice of the invention.

In the synthetic resin tube structure, to weld the plurality of first divided pipes and the plurality of second divided pipes to each other, vibration welding is performed while the direction (line R-R), in which vibrations for welding between the first divided pipes and the plurality of second divided pipes are made, is inclined at an angle θ with respect to a reference plane (line Q-Q) of the flange. As a result, a length A' of a plurality of pipes, which are obtained by welding the first divided pipes and the second divided pipes to each other, at positions where ports are situated, the length being parallel to the line Q-Q, can be reduced as compared with a conventional length A. Specifically, a space can be provided beside one of the pipes at a position perpendicular to the reference plane of the flange, whereby a layout space can be reduced. By providing the space, for example, when the synthetic resin tube structure is used as an intake manifold for the internal combustion engine, the layout space is reduced in an engine room. As a result, space-saving can be achieved. Moreover, for fixing the synthetic resin tube structure to another member, the presence of the space allows facilitation of a fixing operation.

BRIEF DESCRIPTION OF THE DRAWINGS

These and/or other aspects and advantages will become apparent and more readily appreciated from the following description of the embodiments, taken in conjunction with the accompanying drawings of which:

FIG. 5 is a plan view illustrating a welded state of a conventional synthetic resin tube structure;

FIG. 6 is an exploded view of two synthetic-resin members used for FIG. 5; and FIG. 7 is a sectional view taken along the line X-X of FIG. 5.

DETAILED DESCRIPTION OF THE EMBODIMENTS

Figure 1:
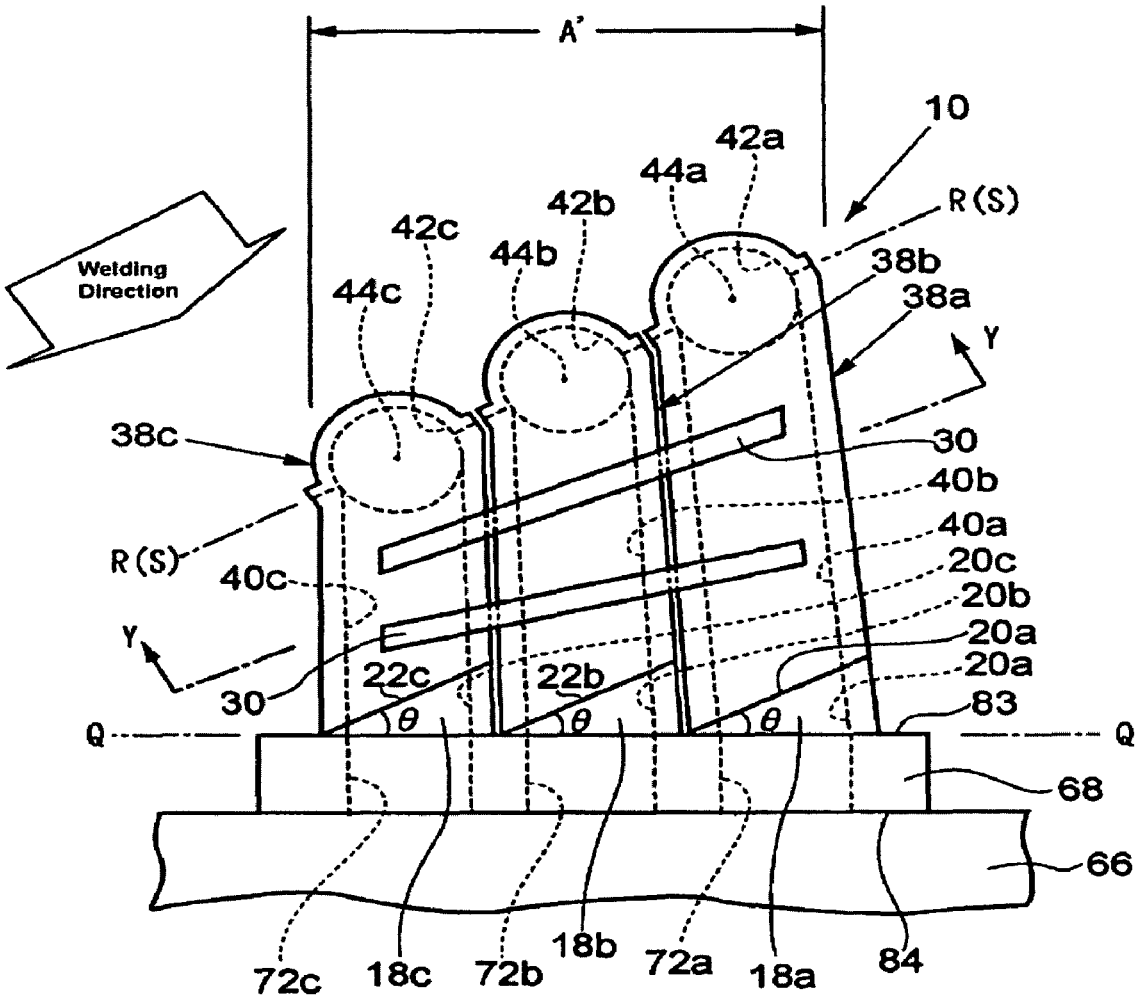
FIG. 1 is a plan view illustrating a welded state of a synthetic resin tube structure according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Figure 2:
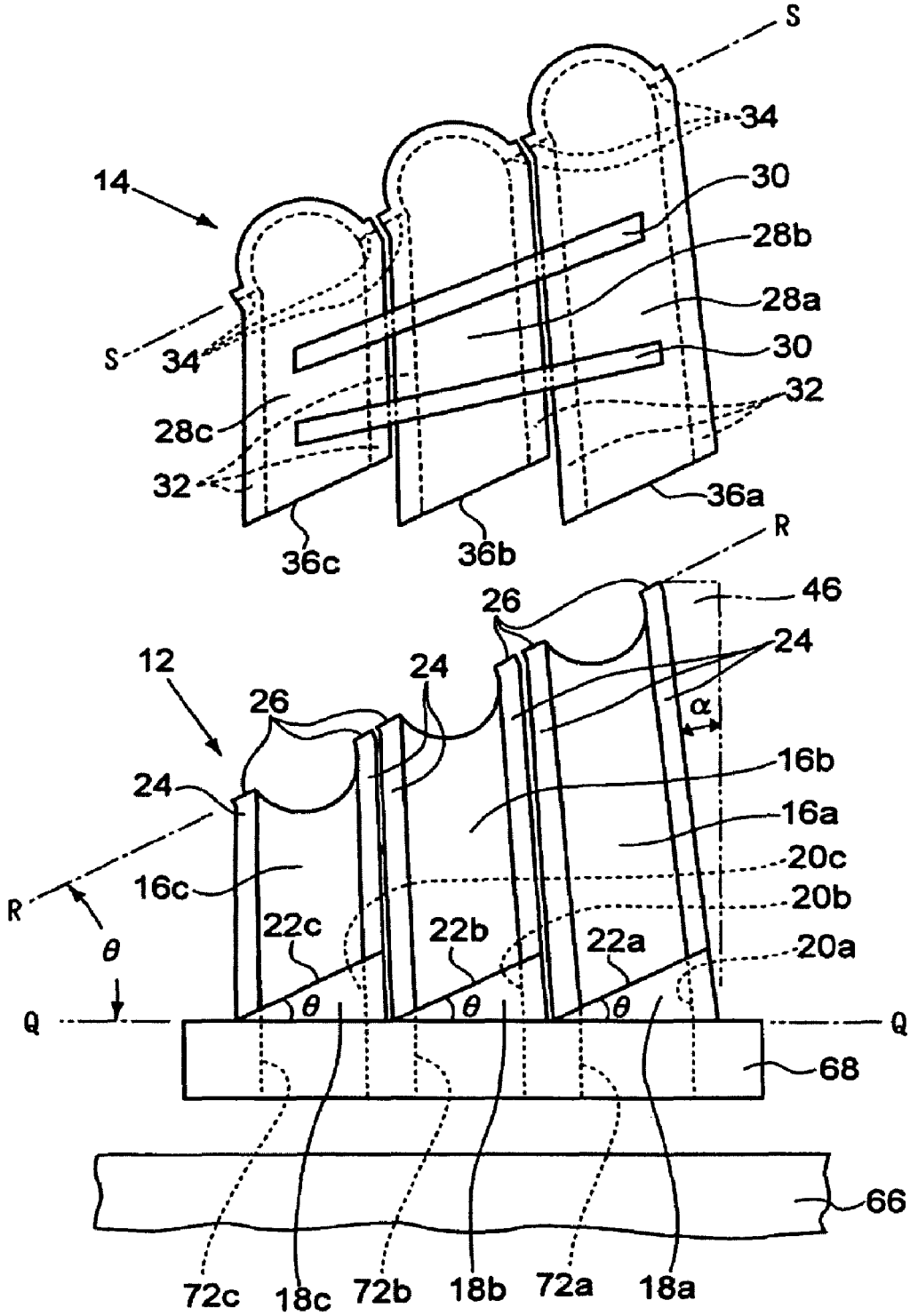
FIG. 2 is an exploded view of two synthetic-resin members used for FIG. 1.
Figure 3:
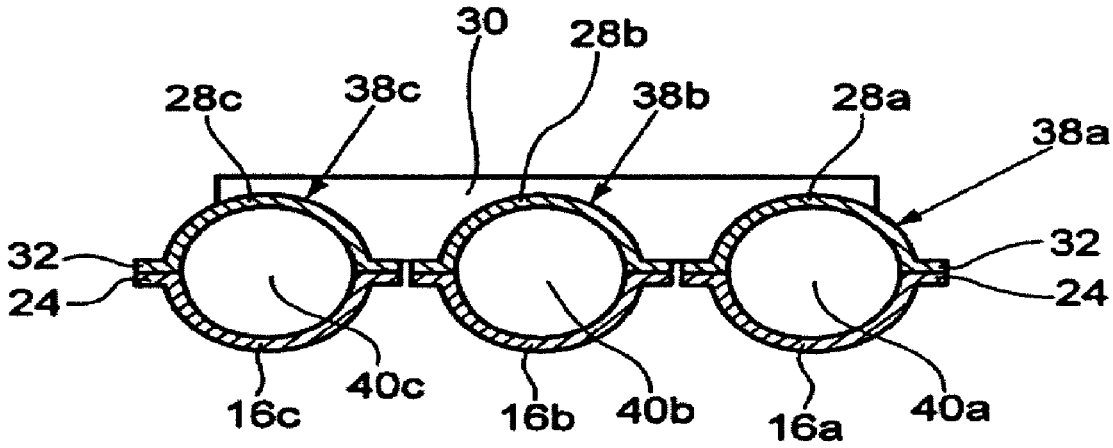
FIG. 3 is a sectional view taken along the line Y-Y of FIG. 1.

FIG. 1 is a plan view illustrating a welded state of a synthetic resin tube structure according to an embodiment, FIG. 2 is an exploded view of two synthetic-resin members used for FIG. 1, and FIG. 3 is a sectional view taken along the line Y-Y of FIG. 1. In FIGS. 1 to 3, the same reference symbol as that in FIGS. 5 to 7 denotes the same member. Here, the synthetic resin tube structure is described as an intake manifold for an internal combustion engine. An intake manifold 10 includes two synthetic-resin members, i.e., a first synthetic-resin member 12 and a second synthetic-resin member 14 and is formed by welding the two synthetic-resin members 12 and 14 together. The first synthetic-resin member 12 includes: the flange 68 to be connected to the engine 66; and a plurality of first divided pipes 16*a*, 16*b*, and 16*c* formed integrally with the flange 68. Through the flange 68, the plurality of bores 72*a*, 72*b*, and 72*c*, each serving as a passage to the engine 66, are formed.

In the embodiment, a direction, in which the first divided pipes 16*a*, 16*b*, and 16*c* extend, is set to be inclined at an angle α with respect to a direction perpendicular to a reference plane of the flange 68 (plane in a direction perpendicular to a direction, in which the bores 72*a*, 72*b*, and 72*c* of the flange 68 extend; any one of the end surfaces 83 and 84) (line Q-Q). For the first divided pipes 16*a*, 16*b*, and 16*c*, pipe portions 18*a*, 18*b*, and 18*c* obtained by cutting obliquely cylindrical pipe portions are respectively formed at positions in the vicinity of the flange 68. Each of the first divided pipes 16*a*, 16*b*, and 16*c* has a semicircular or a semi-elliptical sectional shape in a direction perpendicular to a longitudinal direction thereof in most parts other than each of the pipe portions 18*a*, 18*b*, and 18*c*. Inside the pipe portions 18*a*, 18*b*, and 18*c*, partial passages 20*a*, 20*b*, and 20*c* are respectively formed. The partial passages 20*a*, 20*b*, and 20*c* are respectively in communication with the bores 72*a*, 72*b*, and 72*c*.

Joint edges 22*a*, 22*b*, and 22*c* of the pipe portions 18*a*, 18*b*, and 18*c* on the side opposite to the flange 68 are set to be inclined at an angle θ with respect to the line Q-Q of the end surface 83 of the flange 68. It is desirable that the angle θ be in the range of: $5° \leqq \theta \leqq 40°$. If the angle θ is equal to or less than 5°, a volume of a space 46 described below is reduced to prevent the effects of the present invention from being achieved. If the angle θ is equal to or larger than 40°, the inclination becomes sharp to prevent a necessary sectional area of each of pipes 38*a*, 38*b*, and 38*c* described below from being obtained. On both the right and left sides of each of the first divided pipes 16*a*, 16*b*, and 16*c* (except for the pipe portions 18*a*, 18*b*, and 18*c*), first welding ribs 24 are respectively formed. At a fore-end of each of the first welding ribs 24 provided on both the right and left sides, a first fore-end portion 26 is formed. If a plane which connects the first fore-end portions 26 is indicated by a line R-R in FIG. 1, then the line R-R is set to be arranged at the angle θ with respect to the Q-Q line.

The second synthetic-resin member 14 includes: a plurality of second divided pipes 28*a*, 28*b*, and 28*c* to be welded to the flange 68 and the plurality of first divided pipes 16*a*, 16*b*, and 16*c*; and connectors 30 to connect the plurality of second divided pipes 28*a*, 28*b*, and 28*c* to each other in a fixed manner. Connectors 30 may be integral to the plurality of second divided pipes 28*a*, 28*b*, and 28*c*, or formed separately from the plurality of second divided pipes 28*a*, 28*b*, and 28*c*. Each of the second divided pipes 28*a*, 28*b*, and 28*c* has a semicircular or semi-elliptical sectional shape in a direction perpendicular to a longitudinal direction thereof in most parts. On both the right and left sides of each of the second divided pipes 28*a*, 28*b*, and 28*c*, second welding ribs 32 are respectively formed. A second fore-end portion 34 is formed at a fore-end of the second welding rib 32 formed on each side. The second fore-end portions 34 are located on the same plane, and the same plane is indicated by a line S-S in FIG. 1. The line S-S is set to be aligned with the line R-R which represents the plane connecting the first fore-end portions 26, at the time of welding between the first synthetic-resin member 12 and the second synthetic-resin member 14.

Joint edges 36*a*, 36*b*, and 36*c*, which are respectively to be brought into contact with the joint edge 22*a* of the pipe portion 18*a* of the first divided pipe 16*a*, the joint edge 22*b* of the pipe portion 18*b* of the first divided pipe 16*b*, and the joint edge 22*c* of the pipe portion 18*c* of the first divided pipe 16*c*, are respectively formed to the second divided pipes 28*a*, 28*b*, and 28*c*. Each of the joint edges 36*a*, 36*b*, and 36*c* is set to be parallel to the line S-S.

For welding the first synthetic-resin member 12 and the second synthetic-resin member 14 together, the first welding ribs 24 provided on both the sides of the first divided pipes 16*a*, 16*b*, and 16*c* are respectively brought into contact with the second welding ribs 32 provided on both the sides of the second divided pipes 28*a*, 28*b*, and 28*c* to bring the first fore-end portions 26 provided on both the sides of the first divided pipes 28*a*, 28*b*, and 28*c* into contact with the second fore-end portions 34 provided on both the sides of the second divided pipes 28*a*, 28*b*, and 28*c*, respectively. Further, the joint edge 22*a* of the pipe portion 18*a* of the first divided pipe 16*a*, the joint edge 22*b* of the pipe portion 18*b* of the first divided pipe 16*b*, and the joint edge 22*c* of the pipe portion 18*c* of the first divided pipe 16*c* are respectively brought into contact with the joint edge 36*a* of the second divided pipe 28*a*, the joint edge 36*b* of the second divided pipe 28*b*, and the joint edge 36*c* of the second divided pipe 28*c*. In this state, all the portions being in contact with each other are welded by vibration welding. A direction, in which the first divided pipes 16*a*, 16*b*, and 16*c* and the second divided pipes 28*a*, 28*b*, and 28*c* are vibrated, is parallel to the line R-R (line S-S), and the welding is performed in a direction perpendicular to the line R-R (in a direction indicated by an arrow) of FIG. 1. As a result, the first divided pipes 16*a*, 16*b*, and 16*c* and the second divided pipes 28*a*, 28*b*, and 28*c* are welded to each other. As a result of the welding, the plurality of pipes 38*a*, 38*b*, and 38*c* are formed by the first divided pipes 16*a*, 16*b*, and 16*c* and the second divided pipes 28*a*, 28*b*, and 28*c*. Inside the pipes 38*a*, 38*b*, and 38*c*, passages 40*a*, 40*b*, and 40*c*, each having a circular or elliptical cross section, are respectively formed.

Ends on one side of the passages 40*a*, 40*b*, and 40*c* are respectively in communication with the partial passages 20*a*, 20*b*, and 20*c* formed in the pipe portions 18*a*, 18*b*, and 18*c*. Ports 42*a*, 42*b*, and 42*c* are respectively formed at ends on the other side (ends on the side opposite to the flange 68) of the passages 40*a*, 40*b*, and 40*c*. Here, if the respective center positions of the ports 42*a*, 42*b*, and 42*c* are center points 44*a*, 44*b*, and 44*c*, then a plane containing the center points 44*a*, 44*b*, and 44*c* is positioned on the line R-R (line S-S) in FIG. 1.

The direction in which the first divided pipes 16*a*, 16*b*, and 16*c* and the second divided pipes 28*a*, 28*b*, and 28*c* are vibrated for welding (direction parallel to the line R-R (line S-S)) is set to be inclined at an angle θ with respect to a reference plane of the flange 68 (indicated by the line Q-Q of FIG. 1). As a result, a total width of the three pipes 38*a*, 38*b*, and 38*c* at the positions where the ports 42*a*, 42*b*, and 42*c* are situated when viewed from the direction perpendicular to the line Q-Q of the flange 68 becomes a length A'. The length A' is shorter than the length A of the width of the three pipes 88*a*, 88*b*, and 88*c* at the positions where the ports 92*a*, 92*b*, and 92*c* are situated, which is illustrated in FIG. 5. In other words, a space 46 can be provided beside the pipe 38*a* in the direction perpendicular to the line Q-Q of the flange 68. By providing the space 46, for example, when the synthetic resin tube structure is used as the intake manifold for the internal combustion engine, a layout space can be reduced, thereby achieving space-saving.

Figure 4:
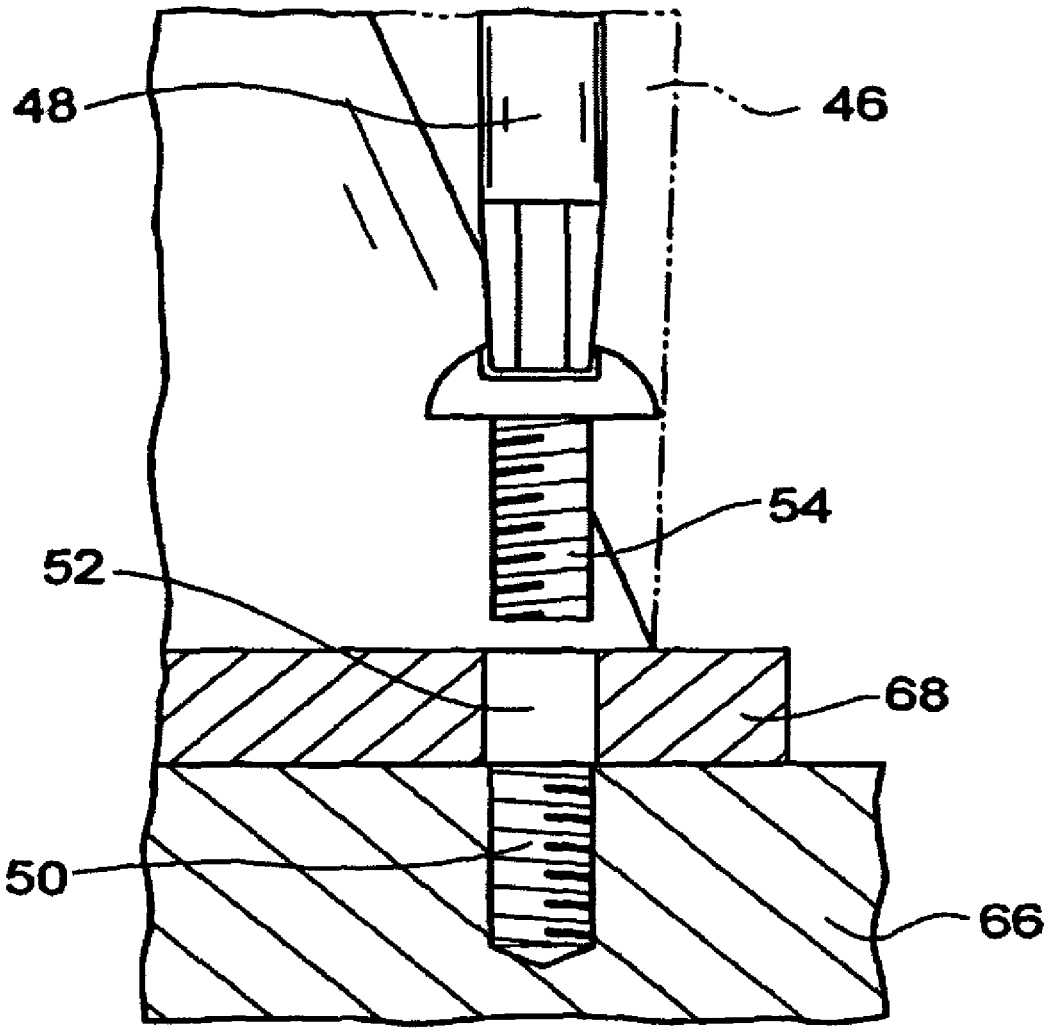
FIG. 4 is a sectional view illustrating a state where the synthetic resin tube structure according to an embodiment is fixed to an engine.

According to the embodiment, by providing the space 46 beside the pipe 38*a* in the direction perpendicular to the reference plane (line Q-Q) of the flange 68, a tool 48 such as a driver can be inserted into the space 46, as illustrated in FIG. 4. For example, an internally threaded portion 50 is formed in the engine 66, whereas a thread-through-hole 52 is formed through the flange 68. An external thread 54 corresponding to a fixing member and the tool 48 are inserted from the space 46. The external thread 54 is inserted from the thread-through-hole 52 of the flange 68 into the internal thread portion 50. Then, the external thread 54 is screwed into the internally threaded portion 48 of the engine 66 by the tool 48. In this manner, the tool 48 can be inserted into the space 46, whereby an operation of fixing the intake manifold 10 to the engine 66 can be facilitated.

Note that, though the synthetic resin tube structure has been described as the intake manifold for the internal combustion engine in the above description, the synthetic resin tube structure is not limited to the intake manifold for the internal combustion engine as long as the synthetic resin tube structure is obtained by vibration-welding the two synthetic-resin members together to form the plurality of pipes therein. Moreover, the three first divided pipes 16*a*, 16*b*, and 16*c* are provided to the first synthetic-resin member 12, whereas the three second divided pipes 28*a*, 28*b*, and 28*c* are provided to the second synthetic-resin member 14. However, the number of the first divided pipes or the second divided pipes is not limited to three. Further, for easy understanding of the description, each of the first divided pipes 16*a*, 16*b*, and 16*c* and the second divided pipes 28*a*, 28*b*; and 28*c* is illustrated linearly in FIG. 1. However, even the first divided pipes 16*a*, 16*b*, and 16*c* and the second divided pipes 28*a*, 28*b*, and 28*c*, which are not linear, can also be used.

Although an embodiment have been shown and described, it would be appreciated by those skilled in the art that changes may be made in this embodiment without departing from the principles and spirit of the invention, the scope of which is defined in the claims and their equivalents.

What is claimed is:

1. A synthetic resin tube structure, comprising:

a first synthetic-resin member which comprises a flange having a plurality of bores formed therein, and a plurality of first divided pipes formed integrally with the flange; and a second synthetic-resin member which comprises a plurality of second divided pipes, and a connector to connect the plurality of second divided pipes to each other, the plurality of first divided pipes and the plurality of second divided pipes having a vibration welding to form a plurality of pipes respectively comprising therein passages which communicate with the respective corresponding bores, and the vibration welding being performed while a direction, in which the plurality of first divided pipes and the plurality of second divided pipes are vibrated, is inclined at an angle θ with respect to a longitudinal axis of the flange.

2. A synthetic resin tube structure according to claim 1, wherein the angle θ falls within a range of $5° \leqq \theta \leqq 40°$.

3. An intake manifold for an internal combustion engine comprising the synthetic resin tube structure according to claim 2.

4. An intake manifold for an internal combustion engine comprising the synthetic resin tube structure according to claim 1.

* * * * *